US008391758B2

(12) United States Patent
Kim et al.

(10) Patent No.: US 8,391,758 B2
(45) Date of Patent: Mar. 5, 2013

(54) COLOR IMAGE FORMING APPARATUS

(75) Inventors: Sung Dae Kim, Suwon-si (KR); Hyun Ki Cho, Hanam-si (KR); Bong Hwan Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 131 days.

(21) Appl. No.: 12/970,353

(22) Filed: Dec. 16, 2010

(65) Prior Publication Data

US 2011/0150516 A1 Jun. 23, 2011

(30) Foreign Application Priority Data

Dec. 17, 2009 (KR) ..... 10-2009-0126324

(51) Int. Cl.
*G03G 15/01* (2006.01)

(52) U.S. Cl. ..... 399/301

(58) Field of Classification Search ..... 399/49, 399/301

See application file for complete search history.

(56) References Cited

U.S. PATENT DOCUMENTS 5,160,946 A * 11/1992 Hwang ..... 347/116
2008/0019739 A1* 1/2008 Oouchi ..... 399/301

* cited by examiner

*Primary Examiner* — Walter L Lindsay, Jr.
*Assistant Examiner* — Frederick Wenderoth
(74) *Attorney, Agent, or Firm* — Staas & Halsey LLP

(57) ABSTRACT

A color image forming apparatus includes a plurality of mark sensing devices are arranged between a plurality of photoconductors arranged on an intermediate transfer belt to sense a mark transferred to a region of the intermediate transfer belt corresponding to an interval between successive recording media. As an exposure time to form an electrostatic latent image on a photoconductor, on which a following developer image will be formed, is determined, minimized mis-registration and consequently, improved color registration correction efficiency are accomplished. Also, automatic color registration correction is performed on per printing operation basis, resulting in improvement in image quality.

16 Claims, 8 Drawing Sheets

COLOR IMAGE FORMING APPARATUS

CROSS-REFERENCE TO RELATED APPLICATIONS

This application claims the benefit of Korean Patent Application No. 10-2009-0126324, filed on Dec. 17, 2009 in the Korean Intellectual Property Office, the disclosure of which is incorporated herein by reference.

BACKGROUND

1. Field

Embodiments of the present invention relate to a color image forming apparatus to enable color registration correction.

2. Description of the Related Art

Generally, in a color image forming apparatus, light is irradiated to a photoconductive drum that has been charged with a predetermined electric potential, to form an electrostatic latent image. After developing the electrostatic latent image using a predetermined color of developer, the resulting developer image is transferred and fused to paper, completing formation of a color image.

Of a variety of color image forming apparatuses, recently, a tandem type color image forming apparatus has been frequently used, in which a plurality of developing devices and photoconductive drums are provided on a per color basis to form an image in a single-pass manner. The tandem type color image forming apparatus includes four photoconductive drums, developing devices, exposure devices and a transfer belt. The four photoconductive drums correspond to yellow, magenta, cyan and black developers. Each exposure device scans light to the corresponding photoconductive drum to form an electrostatic latent image according to a user input.

The developing devices supply different colors of developers to electrostatic latent images formed by the exposure devices to form different colors of developer images. The developer images formed on the respective photoconductive drums are sequentially transferred to and overlap one above another on the transfer belt and in turn, the resulting color image is transferred to paper.

To print an accurate color image, it may be necessary for all of the different colors of developer images to have the same transfer beginning position and the same transfer ending position from the respective photoconductive drums to the transfer belt. Consequently, to accurately realize a color image, it may be important to accurately coincide an exposure time of the exposure devices for the respective photoconductive drums in consideration of a traveling velocity of the transfer belt. Here, accurately setting the exposure time is called color registration.

However, even if the exposure time is initially accurately set, mis-registration may occur as printing proceeds. This is because a driving roller used to travel the transfer belt may expand due to heat generated during printing. Specifically, if the driving roller expands thus changing a diameter thereof, the traveling velocity of the transfer belt may be changed despite constant revolutions per minute of the driving roller and therefore, it may be necessary to adjust the exposure time. Always accurately realizing a desired color image by dynamically controlling the exposure time is called mis-registration correction, i.e. color registration correction.

In a conventional color registration correction method, after exposure devices form predetermined patterns on photoconductive drums and in turn, the predetermined patterns are developed and transferred to a transfer belt, a photosensor including a light emitting element and a light receiving element detects a degree of mis-registration between the respective color patterns, allowing an exposure time of the respective color patterns to be corrected based on the degree of mis-registration.

However, since the corrected exposure time, which is acquired via a single initial calculation, is applied to the overall printing operation, system stability may be essential for perfect color registration correction. However, in an actual system, respective color images may be printed at different positions of respective recording media. This causes mis-registration corresponding to a difference between printing positions of the recording media.

SUMMARY

Therefore, it is an aspect of the embodiments to provide a color image forming apparatus in which an exposure time of each photoconductor is determined on the basis of a time when a mark transferred to a transfer belt passes a previous photoconductor, enabling correction of mis-registration.

Additional aspects of the embodiments will be set forth in part in the description which follows and, in part, will be obvious from the description, or may be learned by practice of the embodiments.

In accordance with one aspect of the embodiments, in a color image forming apparatus including a plurality of photoconductors arranged along a transfer belt, an exposure device to form electrostatic latent images on the plurality of photoconductors, a plurality of developing devices to supply a plurality of colors of developers to the electrostatic latent images formed on the plurality of photoconductors, and a transfer device to transfer developer images formed on the plurality of photoconductors to the transfer belt, the color image forming apparatus further includes a plurality of mark sensing devices arranged between the plurality of photoconductors to sense a mark transferred to a non-image region of the transfer belt, and a controller to form and transfer the mark to the transfer belt and to determine, on the basis of sensing signals generated when the plurality of mark sensing devices sense the mark, an exposure time to form the electrostatic latent image on one of the photoconductors corresponding to one of the mark sensing devices that senses the mark.

The non-image region of the transfer belt may be a region corresponding to an interval between successive recording media to which an image is transferred by the transfer belt.

A color of the mark may be a color of a first one of the plurality of developer images transferred from the plurality of photoconductors to the transfer belt.

A color of the mark may be a color of the developer image transferred from one of the plurality of photoconductors to the transfer belt before the mark sensing devices sense the mark.

The controller may determine the photoconductor, corresponding to the mark sensing device that senses the mark, as a photoconductor for formation of a following color developer image.

The controller may control the exposure device to form the mark on one of the plurality of photoconductors to allow the mark to be transferred to the non-image region of the transfer belt each time a recording medium is printed.

The controller may control operation of the exposure device to form the electrostatic latent image on the photoconductor corresponding to the mark sensing device that senses the mark according to the determined exposure time.

The controller may determine the exposure time by adding a predetermined time to the sensed time of the mark.

The predetermined time may be a time required for the transfer belt to be fed by a distance between the mark and an image region of the transfer belt.

In accordance with another aspect of the embodiments, a color image forming apparatus includes a plurality of photoconductors arranged along a transfer belt to form a mark on a non-image region of the transfer belt, a plurality of mark sensing devices arranged between the plurality of photoconductors to sense the mark transferred to the non-image region of the transfer belt, and a controller to determine an exposure time to form an electrostatic latent image on one of the photoconductors corresponding to one of the mark sensing devices that senses the mark on the basis of a sensed time of the mark, wherein the controller determines, on the basis of a color of a developer image transferred from one of the plurality of photoconductors to the transfer belt before the mark sensing devices sense the mark, the photoconductor, corresponding to the mark sensing device that senses the mark, as a photoconductor for formation of a following color developer image.

The non-image region of the transfer belt may be a region corresponding to an interval between successive recording media to which an image is transferred by the transfer belt.

A different color mark may be transferred to the non-image region of the transfer belt on a per recording medium basis under control of the controller.

In accordance with a further aspect, a color image forming apparatus includes four photoconductors arranged along a transfer belt, an exposure device to form electrostatic latent images on the plurality of photoconductors, four developing devices to supply yellow, magenta, cyan and black developers to the electrostatic latent images formed on the plurality of photoconductors, a transfer device to transfer developer images formed on the plurality of photoconductors to the transfer belt, three mark sensing devices arranged between the four photoconductors to sense a mark transferred to a non-image region of the transfer belt, and a controller to control operation of the exposure device and the transfer device to transfer a yellow mark to a partial region of the non-image region corresponding to an interval between successive recording media if a print command is input, and to determine an exposure time of one of the photoconductors for formation of a following color developer image on the basis of a sensed time of the yellow mark each time the yellow mark is sensed.

The controller may control operation of the exposure device and the transfer device to transfer the yellow mark to the region of the transfer belt corresponding to the interval between successive recording media on per recording medium basis.

The controller may determine the exposure time of the respective photoconductors for formation of the following color developer images based on the sensed time of the yellow mark each time the yellow mark is sensed.

The controller may determine the exposure time by adding a predetermined time to the sensed time of the mark.

According to an aspect, a method of controlling printing time for an image forming apparatus, including: detecting a time by sensing a mark on a intermediate transfer belt; determining an exposure time using the detected time for formation of a following color developer image; developing an electrostatic latent image for the determined exposure time; and transferring and fusing the developed electrostatic latent image on a printing medium.

The determining the exposure time is by adding a predetermining time to the detected time.

BRIEF DESCRIPTION OF THE DRAWINGS

These and/or other aspects of the embodiments will become apparent and more readily appreciated from the following description of the embodiments, taken in conjunction with the accompanying drawings of which.

DETAILED DESCRIPTION

Figure 1:
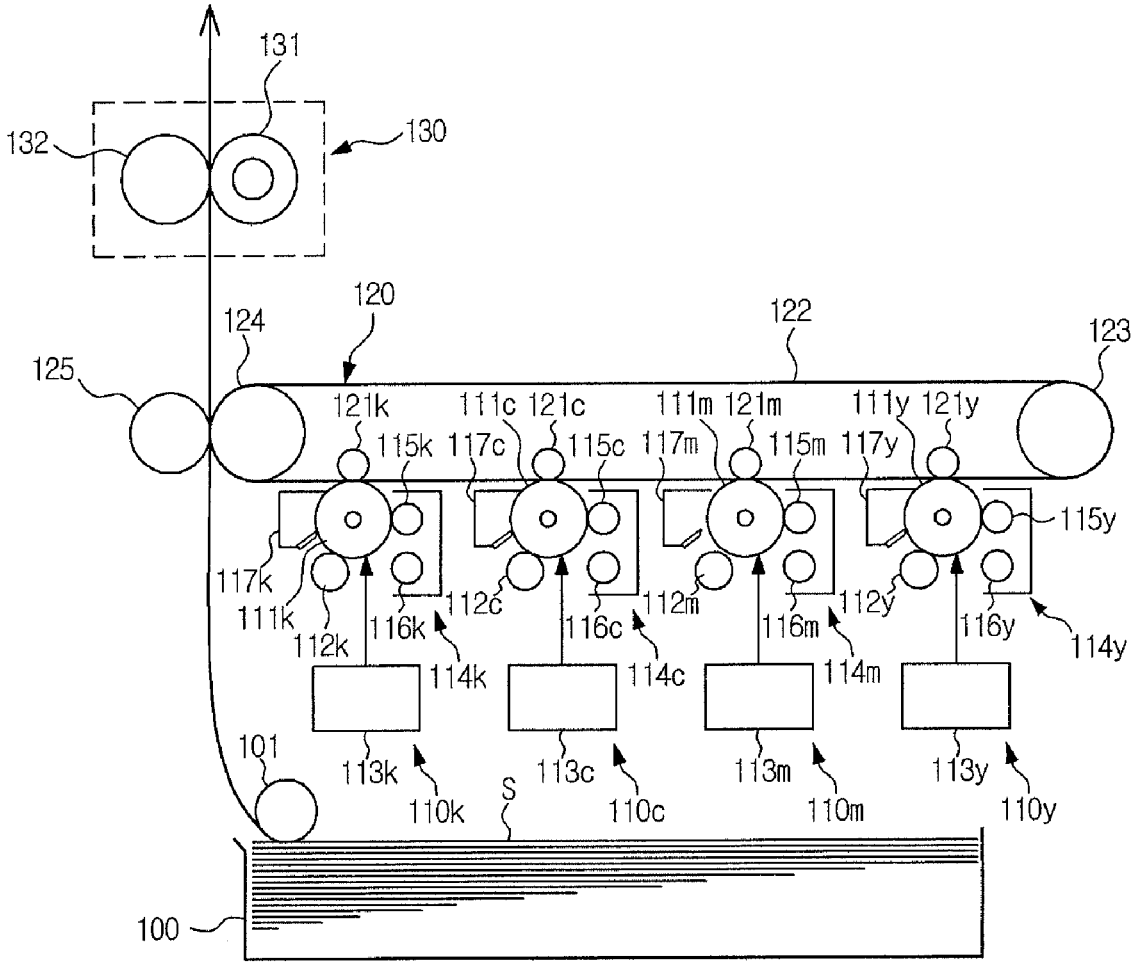
FIG. 1 is a view illustrating a schematic configuration of a color image forming apparatus according to an embodiment.

Reference will now be made in detail to the embodiments of the present invention, examples of which are illustrated in the accompanying drawings, wherein like reference numerals refer to like elements throughout.

FIG. 1 is a view illustrating a schematic configuration of a color image forming apparatus according to an embodiment.

As illustrated in FIG. 1, a color image forming apparatus according to an embodiment includes a paper supply device 100, image forming devices 110*y*, 110*m*, 110*c* and 110*k*, a transfer device 120, and a fusing device 130.

The paper supply device 100 supplies recording media S such as paper, etc. The recording media S loaded in a paper supply cassette is picked up and fed by a pickup roller 101.

The image forming devices 110*y*, 110*m*, 110*c* and 110*k* are arranged above the paper supply device 100 and develop predetermined colors of images, e.g., yellow, magenta, cyan and black developer images Y, M, C and K respectively.

The image forming devices 110*y*, 110*m*, 110*c* and 110*k* include first, second, third and fourth photoconductors 111*y*, 111*m*, 111*c* and 111*k*. The first, second, third and fourth photoconductors 111*y*, 111*m*, 111*c* and 111*k* are horizontally arranged opposite to an intermediate transfer belt 122 of the transfer device 120 starting from the right side to the left side of the drawing with a predetermined interval. The first, second, third and fourth photoconductors 111*y*, 111*m*, 111*c* and 111*k* come into contact with the intermediate transfer belt 122 at a constant pressure by first, second, third and fourth transfer rollers 121*y*, 121*m*, 121*c* and 121*k* to define nips. All the first, second, third and fourth photoconductors 111*y*, 111*m*, 111*c* and 111*k* are rotated counterclockwise by gear members upon receiving power from a motor.

First, second, third and fourth charge devices 112*y*, 112*m*, 112*c* and 112*k*, first, second, third and fourth exposure devices 113*k*, 113*m*, 113*c* and 113*y*, and first, second, third and fourth developing devices 114*y*, 114*m*, 114*c* and 114*k* are arranged around the first, second, third and fourth photoconductors 111*y*, 111*m*, 111*c* and 111*k*.

The first, second, third and fourth charge devices 112*y*, 112*m*, 112*c* and 112*k* include charge rollers. The first, second, third and fourth charge devices 112*y*, 112*m*, 112*c* and 112*k* come into contact with surfaces of the first, second, third and fourth photoconductors 111*y*, 111*m*, 111*c* and 111*k*.

Once the first, second, third and fourth photoconductors 111*y*, 111*m*, 111*c* and 111*k* are charged by the first, second, third and fourth charge devices 112*y*, 112*m*, 112*c* and 112*k*, the first, second, third and fourth exposure devices 113*k*, 113*m*, 113*c* and 113*y* irradiate laser beams to the surfaces of the first, second, third and fourth photoconductors 111*y*, 111*m*, 111*c* and 111*k* according to image signals input from a computer, scanner, etc., thus forming electrostatic latent images having a low electric potential, e.g., approximately −50V lower than a charge electric potential. Here, the first, second, third and fourth exposure devices 113*k*, 113*m*, 113*c* and 113*y* have a generally known configuration and thus, a detailed description thereof will be omitted herein.

The first, second, third and fourth developing devices 114*y*, 114*m*, 114*c* and 114*k* attach corresponding color developers to the surfaces of the first, second, third and fourth photoconductors 111*y*, 111*m*, 111*c* and 111*k* on which the electrostatic latent images have been formed, thus developing the electrostatic latent images into developer images. The first, second, third and fourth developing devices 114*y*, 114*m*, 114*c* and 114*k* include first, second, third and fourth developing rollers 115*y*, 115*m*, 115*c* and 115*k* and first, second, third and fourth developer supply rollers 116*y*, 116*m*, 116*c* and 116*k*.

The first, second, third and fourth developing rollers 115*y*, 115*m*, 115*c* and 115*k* are rotated while being engaged with the first, second, third and fourth photoconductors 111*y*, 111*m*, 111*c* and 111*k*, thus serving to attach the corresponding color developers to the electrostatic latent images of the first, second, third and fourth photoconductors 111*y*, 111*m*, 111*c* and 111*k* to develop the electrostatic latent images.

The first, second, third and fourth developer supply rollers 116*y*, 116*m*, 116*c* and 116*k* supply the developers to the first, second, third and fourth developing rollers 115*y*, 115*m*, 115*c* and 115*k* using electric potential difference with the first, second, third and fourth developing rollers 115*y*, 115*m*, 115*c* and 115*k*.

First, second, third and fourth cleaning devices 117*y*, 117*m*, 117*c* and 117*k* are used to remove a waste developer remaining on the surfaces of the first, second, third and fourth photoconductors 111*y*, 111*m*, 111*c* and 111*k* after every one cycle rotation thereof.

The transfer device 120 includes the first, second, third and fourth transfer rollers 121*y*, 121*m*, 121*c* and 121*k*, the intermediate transfer belt 122 and a final transfer roller 125. The developer images formed on the first, second, third and fourth photoconductors 111*y*, 111*m*, 111*c* and 111*k* are transferred to the intermediate transfer belt 122 by the first, second, third and fourth transfer rollers 121*y*, 121*m*, 121*c* and 121*k*. The resulting transferred image on the intermediate transfer belt 122 is transferred to the recording medium S supplied from the paper supply device 100 when the recording medium S passes between the final transfer roller 125 and the intermediate transfer belt 122.

The intermediate transfer belt 122 is wound on a driving roller 123 and a supporting roller 124 which come into contact with an inner surface of the intermediate transfer belt 122. The intermediate transfer belt 122 travels from the first developing device 114*y* to the fourth developing device 114*k*.

The first, second, third and fourth transfer rollers 121*y*, 121*m*, 121*c* and 121*k* are transfer voltage applying members to apply a predetermined transfer bias voltage to the intermediate transfer belt 122. The first, second, third and fourth transfer rollers 121*y*, 121*m*, 121*c* and 121*k* are arranged respectively to pressurize the intermediate transfer belt 122 against the first, second, third and fourth photoconductors 111*y*, 111*m*, 111*c* and 111*k* at a constant pressure inside the intermediate transfer belt 122. To this end, the predetermined bias voltage is applied to the first, second, third and fourth transfer rollers 121*y*, 121*m*, 121*c* and 121*k*.

The final transfer roller 125 and the intermediate transfer belt 122 are installed to face each other. The final transfer roller 125 is spaced apart from the intermediate transfer belt 122 while the developer images are being transferred to the intermediate transfer belt 122. After the developer images are completely transferred to the intermediate transfer belt 122, the final transfer roller 125 comes into contact with the intermediate transfer belt 122 at a predetermined pressure. The predetermined transfer bias voltage is applied to the final transfer roller 125 to transfer the resulting transferred image from the intermediate transfer belt 122 to the recording medium S.

The fusing device 130 fuses the image transferred to the recording medium S. The fusing device 130 includes a heating roller 131 and a press roller 132. The heating roller 131 contains a heater to fuse the image to the recording medium S by high-temperature heat.

An elastic press member is provided to press the press roller 132 toward the heating roller 131 to press the recording medium S.

Figure 2:
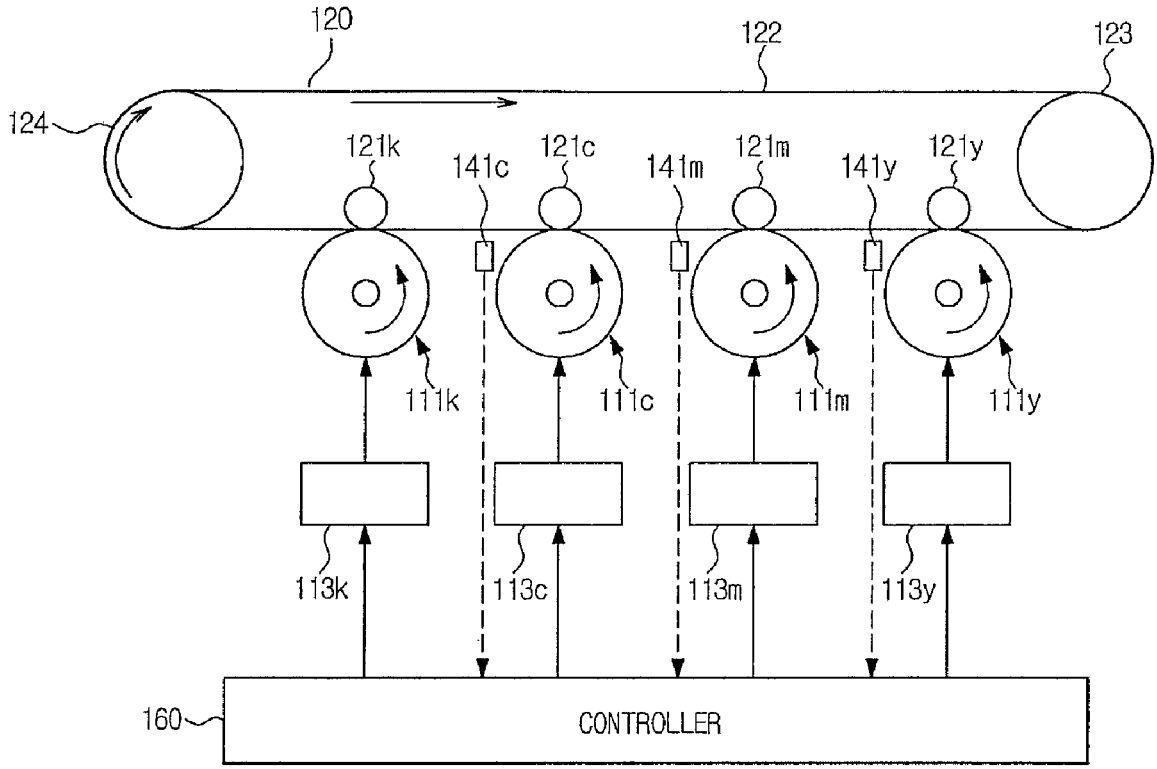
FIG. 2 is a schematic control block diagram of the color image forming apparatus according to an embodiment.

FIG. 2 is a schematic control block diagram of the color image forming apparatus according to an embodiment.

As illustrated in FIG. 2, the color image forming apparatus according to the embodiment includes a controller 160 to control operations of the image forming apparatus, and three mark sensing devices 141*y*, 141*m* and 141*c* arranged between the four photoconductors 111*y*, 111*m*, 111*c* and 111*k*.

The mark sensing devices 141*y*, 141*m* and 141*c* include Color Toner Density (CTD) sensors. The mark sensing devices 141*y*, 141*m* and 141*c* is used to sense a mark transferred to the intermediate transfer belt 122 by irradiating infrared light to the mark and sensing the light reflected from the mark.

If a print command is input on a per recording medium basis, under control of the controller 160, a color mark (e.g., a yellow mark) is formed by use of a reference photoconductor (e.g., the photoconductor 111*y*) of the four color photoconductors. After the mark is transferred to a non-image region of the intermediate transfer belt 122 (e.g., a region corresponding to an interval between one recording medium and a following recording medium), an exposure time to form an electrostatic latent image on the following photoconductor is determined on the basis of a time when each of the mark sensing devices 141*y*, 141*m* and 141*c* senses the mark. Accordingly, it may be possible to minimize mis-registration by controlling operation of each exposure device 113*y*, 113*m*, 113*c* or 113*k* and the transfer device 120 based on the determined exposure time. This consequently may improve registration correction efficiency and may enable automatic color registration correction each time the recording medium is printed, resulting in improvement in image quality.

For example, if a print command is input, the controller 160 forms a mark on the first photoconductor 111*y* and subsequently, supplies a yellow developer to the mark formed on the first photoconductor 111*y* via the first developing device 114*y* to develop a yellow mark and thereafter, transfers the yellow mark to the non-image region of the intermediate transfer belt 122. Next, the controller 160 determines an exposure time to form a following developer image on the second photoconductor 111*m* according to a sensing signal generated when the first mark sensing device 141*y* senses the yellow mark. Repeatedly, the controller 160 determines an exposure time to form a following developer image on the third photoconductor 111*c* according to a sensing signal generated when the second mark sensing device 141*m* senses the yellow mark and also, determines an exposure time to form a following developer image on the fourth photoconductor 111*k* according to a sensing signal generated when the third mark sensing device 141*c* senses the yellow mark.

Figure 3:
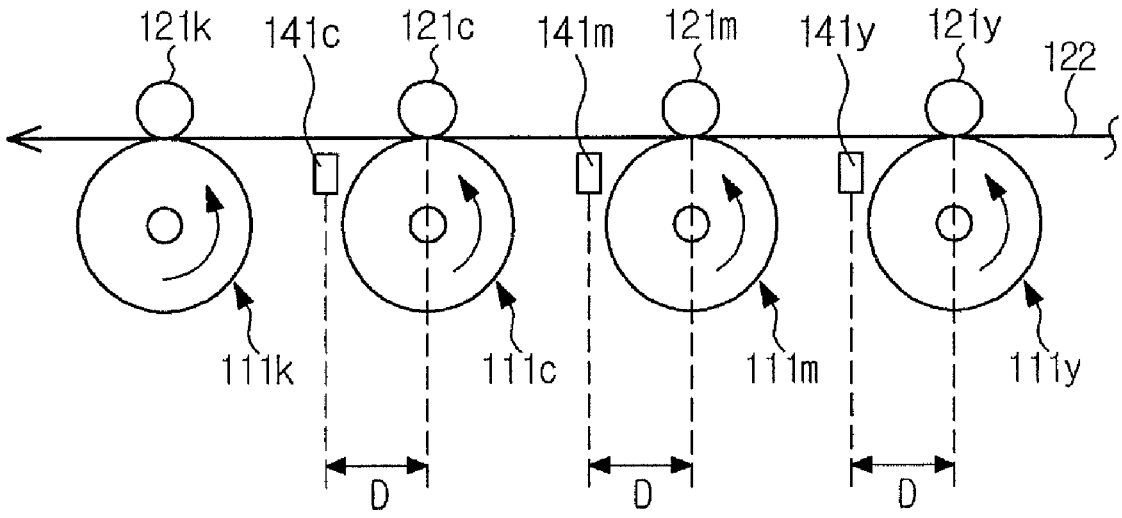
FIG. 3 is a view illustrating an arrangement of three mark sensing devices provided in the color image forming apparatus according to an embodiment.

FIG. 3 is a view illustrating an arrangement of the three mark sensing devices provided in the color image forming apparatus according to an embodiment.

As illustrated in FIG. 3, the three mark sensing devices 141*y*, 141*m* and 141*c* are arranged between the respective photoconductors 111*y*, 111*m*, 111*c* and 111*k*, respectively.

The first mark sensing device 141*y* is arranged between the first photoconductor 111*y* and the second photoconductor 111*m*. The first mark sensing device 141*y* is spaced apart from the first photoconductor 111*y* by a distance D. For example, the first mark sensing device 141*y* may be arranged close to the first photoconductor 111*y*.

The second mark sensing device 141*m* is arranged between the second photoconductor 111*m* and the third photoconductor 111*c*. The second mark sensing device 141*m* is spaced apart from the second photoconductor 111*m* by a distance D. For example, the second mark sensing device 141*m* may be arranged close to the second photoconductor 111*m*.

The third mark sensing device 141*c* is arranged between the third photoconductor 111*c* and the fourth photoconductor 111*k*. The third mark sensing device 141*c* is spaced apart from the third photoconductor 111*c* by a distance D. For example, the third mark sensing device 141*c* may be arranged close to the third photoconductor 111*c*.

Figure 4:
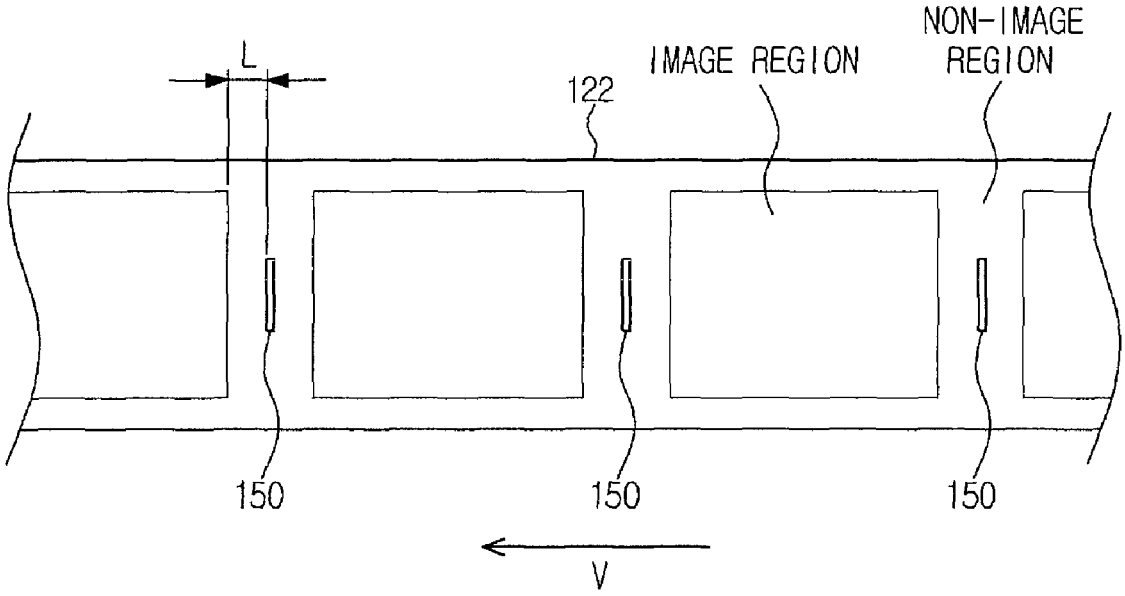
FIG. 4 is a view illustrating a mark formed in a non-image region between image regions included in an intermediate transfer belt of the color image forming apparatus according to an embodiment.

FIG. 4 is a view illustrating a mark formed in the non-image region between image regions included in an intermediate transfer belt of the color image forming apparatus according to an embodiment;

As illustrated in FIG. 4, the intermediate transfer belt 122 may be divided into image regions and the non-image region. The image regions are regions to which the images, formed on the respective photoconductors 111*y*, 111*m*, 111*c* and 111*k* corresponding to data to be printed on the recording medium S, are transferred respectively. The non-image region is a remaining region of the intermediate transfer belt 122 except for the image regions. A mark 150 is transferred to a part of the non-image region corresponding to an interval between one recording medium and a following recording medium. For example, the mark 150 may have a bar shape and may be transferred to the non-image region of the intermediate transfer belt 122. The mark 150 is oriented perpendicular to a feed direction of the intermediate transfer belt 122 represented by the arrow. Of course, other various shapes of marks may be adopted.

Assuming that a distance between the mark 150 and the image region is "L" and a feed velocity of the intermediate transfer belt 122 is "V", a time T required for movement of the distance L at the velocity V may be calculated.

The controller 160 determines an exposure time of a following photoconductor by adding the time T to a time when the mark sensing device 141*y*, 141*m* or 141*c* senses the mark 150. In this case, the exposure time means a time from which an electrostatic latent image begins to be formed on a photoconductor. Actual formation of the electrostatic latent image on the photoconductor is determined by data to be printed and the exposure time.

A case where a reference photoconductor is the yellow photoconductor 111*y* and the mark 150 is a yellow mark 151*y* will be described hereinafter.

Figure 5:
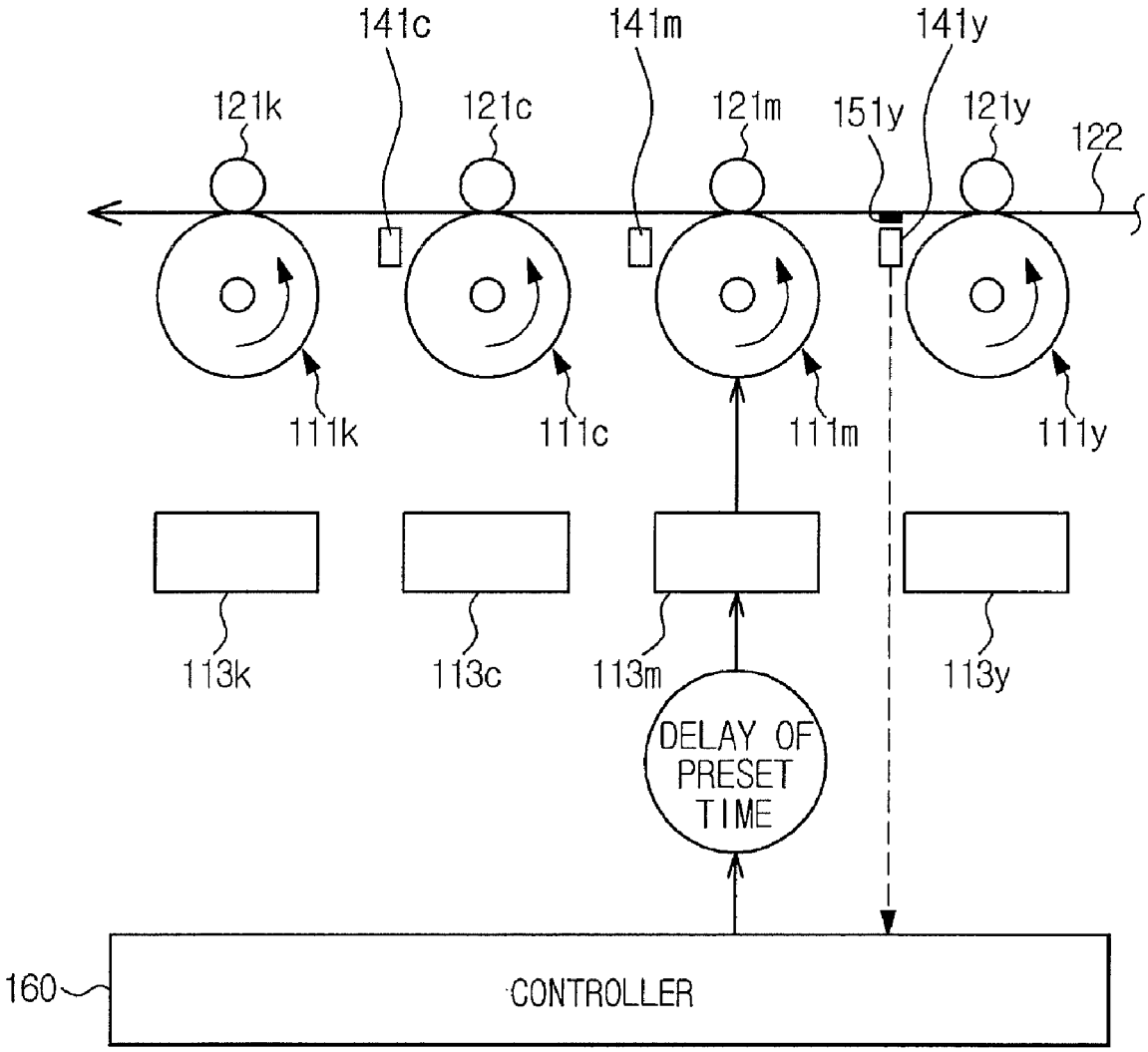
FIG. 5 is a view illustrating exposure of a magenta photoconductor after delay of a predetermined time T from a time when a first mark sensing device senses a mark according to an embodiment.

As illustrated in FIG. 5, the controller 160 begins exposure of the magenta photoconductor 111*m* via the magenta exposure device 113*m* after the time T passes from a time when the first mark sensing device 141*y* senses the yellow mark 151*y*. In this case, the controller 160 calculates an exposure time by adding the time T to the time when the first mark sensing device 141*y* senses the yellow mark 151*y*, allowing the magenta photoconductor 111*m* to be exposed after delay of the time T from the sensed time of the yellow mark 151*y*.

Figure 6:
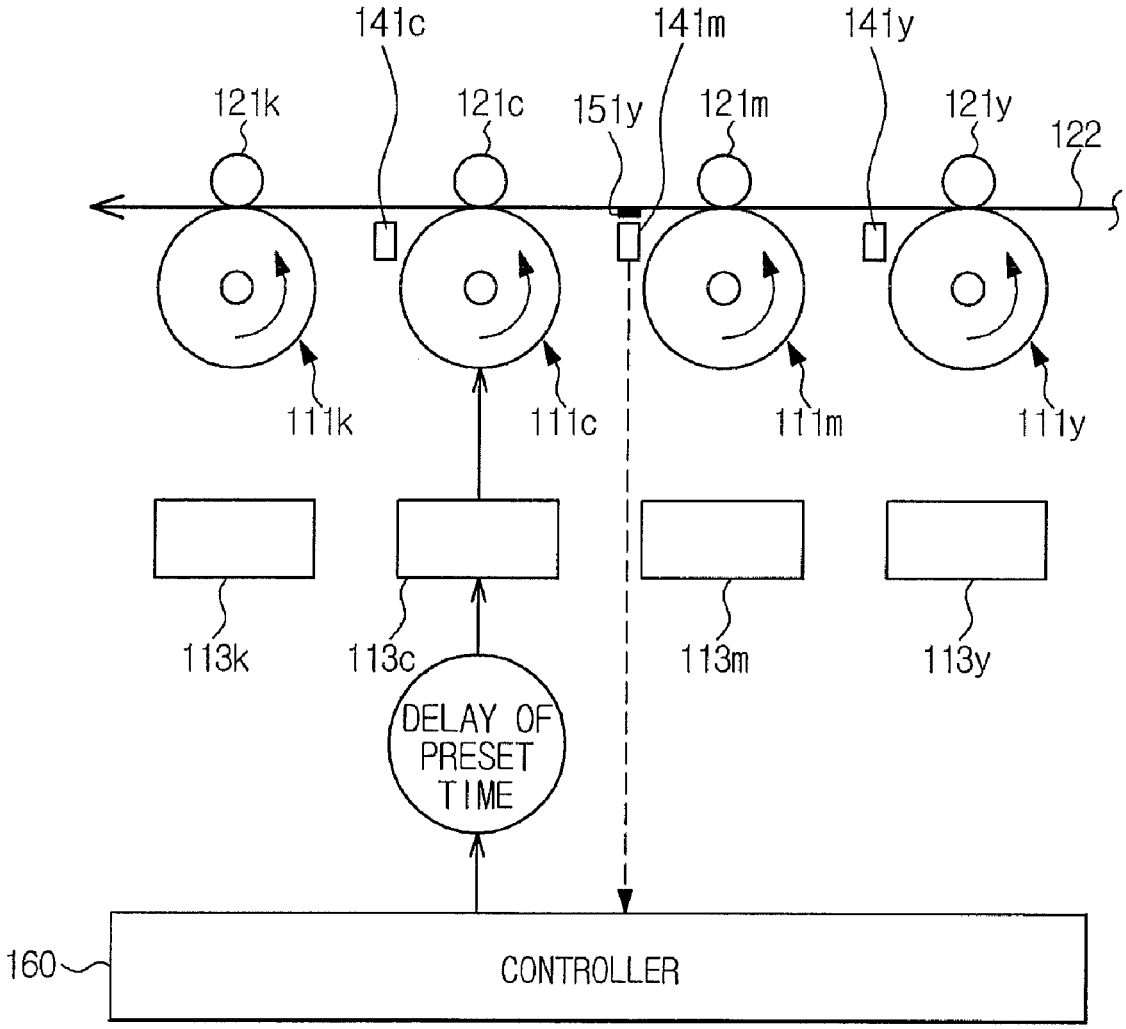
FIG. 6 is a view illustrating exposure of a cyan photoconductor after delay of a predetermined time T from a time when a second mark sensing device senses a mark according to an embodiment.

As illustrated in FIG. 6, the controller 160 begins exposure of the cyan photoconductor 111*c* via the cyan exposure device 113*c* after the time T passes from a time when the second mark sensing device 141*m* senses the yellow mark 151*y*. Similarly, the controller 160 calculates an exposure time by adding the time T to the time when the second mark sensing device 141*m* senses the yellow mark 151*y*, allowing the cyan photoconductor 111*c* to be exposed after delay of the time T from the sensed time of the yellow mark 151*y*.

Figure 7:
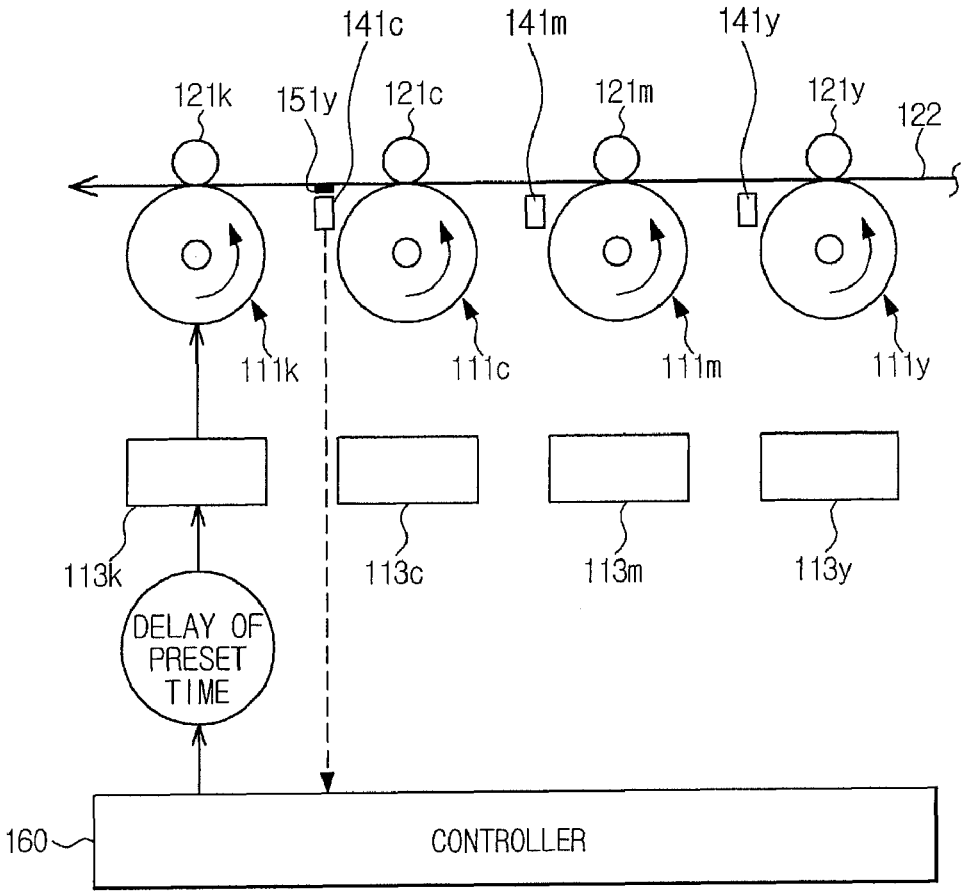
FIG. 7 is a view illustrating exposure of a black photoconductor after delay of a predetermined time T from a time when a third mark sensing device senses a mark according to an embodiment.

As illustrated in FIG. 7, the controller 160 begins exposure of the black photoconductor 111*k* via the black exposure device 113*k* after the time T passes from a time when the third mark sensing device 141*c* senses the yellow mark 151*y*. Similarly, the controller 160 calculates an exposure time by adding the time T to the time when the third mark sensing device 141*c* senses the yellow mark 151*y*, allowing the black photoconductor 111*k* to be exposed after delay of the time T from the sensed time of the yellow mark 151*y*.

In this way, it may be possible to acquire a uniform exposure time of following photoconductors on the basis of a time when a mark, transferred from a reference photoconductor to the intermediate transfer belt, is sensed. This may minimize mis-registration and consequently, may improve registration correction efficiency. Furthermore, the automatic color registration correction may be performed on a per printing operation basis, resulting in further improved image quality.

Figure 8:
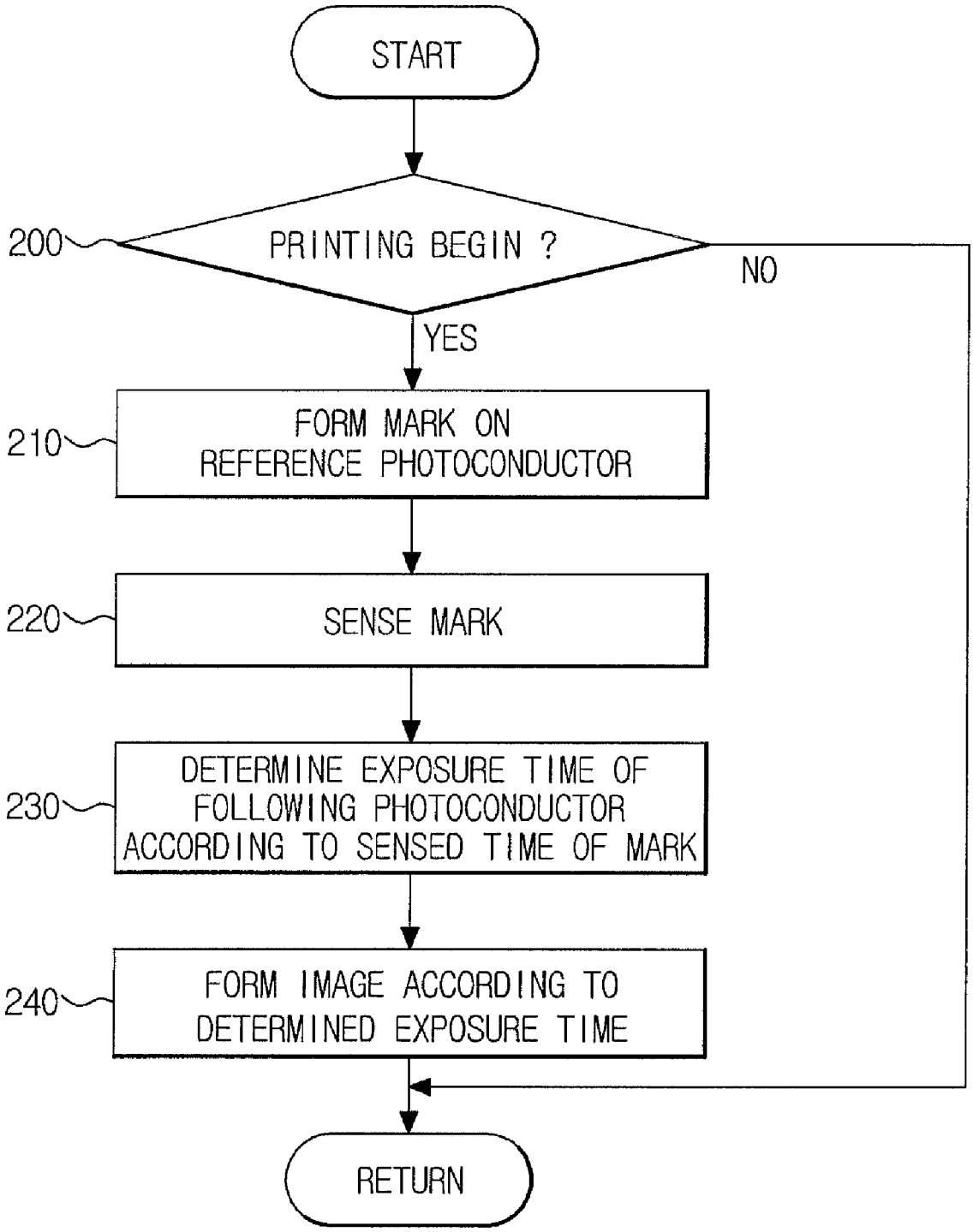
FIG. 8 is a control flow chart of the color image forming apparatus according to an embodiment.

FIG. 8 is a schematic control flow chart of the color image forming apparatus according to an embodiment.

Referring to FIG. 8, if a printing operation begins (200), the controller 160 forms the mark 150 on the reference photoconductor via the corresponding exposure device (210). The mark 150 formed on the reference photoconductor is transferred to the intermediate transfer belt 122.

Then, the controller 160 allows the respective mark sensing devices 141*y*, 141*m* and 141*c* to sense the mark 150 transferred to the intermediate transfer belt 122 (220).

After the mark 150 is sensed, the controller 160 determines an exposure time of a following photoconductor according to a sensed time of the mark 150 (230).

Thereafter, the controller 160 controls formation of an image on the determined exposure time (240). As illustrated in FIG. 5, the controller 160 determines an exposure time by adding the time T to the time when the first mark sensing device 141*y* senses the yellow mark 151*y*, thus allowing the magenta photoconductor 111*m* to be exposed after delay of the time T from the sensed time of the yellow mark 151*y*. Next, as illustrated in FIG. 6, the controller 160 determines an exposure time by adding the time T to the time when the second mark sensing device 141*m* senses the yellow mark 151*y*, thus allowing the cyan photoconductor 111*c* to be exposed after delay of the time T from the sensed time of the yellow mark 151*y*. Next, as illustrated in FIG. 7, the controller 160 determines an exposure time by adding the time T to the time when the third mark sensing device 141*c* senses the yellow mark 151*y*, thus allowing the black photoconductor 111*k* to be exposed after delay of the time T from the sensed time of the yellow mark 151*y*.

As apparent from the above description, according to the embodiment, sensors arranged between a plurality of photoconductors respectively sense a mark transferred to a transfer belt each time a recording medium is printed, to optimize an exposure time of following photoconductors of different colors on the basis of a sensed time of the mark, thus realizing minimized mis-registration. This consequently may improve color registration correction efficiency and may enable automatic color registration correction on a per printing operation basis, resulting in improvement in image quality.

Although the embodiment has been shown and described, it would be appreciated by those skilled in the art that changes may be made in these embodiments without departing from the principles and spirit of the invention, the scope of which is defined in the claims and their equivalents.

What is claimed is:

1. A color image forming apparatus comprising:

a plurality of photoconductors arranged along an intermediate transfer belt;

an exposure device to form electrostatic latent images on the plurality of photoconductors;

a plurality of developing devices to supply a plurality of colors of developers to the electrostatic latent images formed on the plurality of photoconductors;

a transfer device to transfer developer images formed on the plurality of photoconductors to the intermediate transfer belt;

a plurality of mark sensing devices arranged between the plurality of photoconductors to sense a mark transferred to a non-image region of the intermediate transfer belt; and a controller to form and transfer the mark to the transfer belt and to determine, on the basis of sensing signals generated when the plurality of mark sensing devices sense the mark, an exposure time to form the electrostatic latent image on one of the photoconductors corresponding to one of the mark sensing devices that senses the mark, wherein the controller determines the exposure time by adding a predetermined time to the sensed time of the mark, and the predetermined time is a time required for the intermediate transfer belt to be fed by a distance between the mark and an image region of the intermediate transfer belt.

2. The apparatus according to claim 1, wherein the non-image region of the intermediate transfer belt is a region corresponding to an interval between successive recording media to which an image is transferred by the intermediate transfer belt.

3. The apparatus according to claim 2, wherein a color of the mark is a color of a first one of the plurality of developer images transferred from the plurality of photoconductors to the intermediate transfer belt.

4. The apparatus according to claim 2, wherein a color of the mark is a color of the developer image transferred from one of the plurality of photoconductors to the intermediate transfer belt before the mark sensing devices sense the mark.

5. The apparatus according to claim 3, wherein the controller determines the photoconductor, corresponding to the mark sensing device that senses the mark, as a photoconductor for formation of a following color developer image.

6. The apparatus according to claim 4, wherein the controller determines the photoconductor, corresponding to the mark sensing device that senses the mark, as a photoconductor for formation of a following color developer image.

7. The apparatus according to claim 2, wherein the controller controls the exposure device to form the mark on one of the plurality of photoconductors in order to allow the mark to be transferred to the non-image region of the intermediate transfer belt each time a recording medium is printed.

8. The apparatus according to claim 1, wherein the controller controls operation of the exposure device to form the electrostatic latent image on the photoconductor corresponding to the mark sensing device that senses the mark according to the determined exposure time.

9. A color image forming apparatus, comprising:

a plurality of photoconductors arranged along an intermediate transfer belt to form a mark on a the intermediate transfer belt;

a plurality of mark sensing devices arranged between the plurality of photoconductors to sense the mark transferred to the intermediate transfer belt; and a controller to determine an exposure time to form an electrostatic latent image on one of the photoconductors corresponding to one of the mark sensing devices that senses the mark on the basis of a sensed time of the mark, wherein the controller determines, on the basis of a color of a developer image transferred from one of the plurality of photoconductors to the intermediate transfer belt before the mark sensing devices sense the mark, the photoconductor, corresponding to the mark sensing device that senses the mark, as a photoconductor for formation of a following color developer image, and wherein the controller determines the exposure time by adding a predetermined time to the sensed time of the mark, and the predetermined time is a time required for the intermediate transfer belt to be fed by a distance between the mark and an image region of the intermediate transfer belt.

10. The apparatus according to claim 9, wherein the region on the intermediate transfer belt is non-image region corresponding to an interval between successive recording media to which an image is transferred by the intermediate transfer belt.

11. The apparatus according to claim 10, wherein a different color mark is transferred to a non-image region of the intermediate transfer belt on per a recording medium basis under control of the controller.

12. A color image forming apparatus, comprising:

four photoconductors arranged along an intermediate transfer belt;

an exposure device to form electrostatic latent images on the plurality of photoconductors;

four developing devices to supply yellow, magenta, cyan., and black developers to the electrostatic latent images formed on the plurality of photoconductors;

a transfer device to transfer developer images formed on the plurality of photoconductors to the intermediate transfer belt;

three mark sensing devices arranged between the four photoconductors to sense a mark transferred to a non-image region of the intermediate transfer belt; and a controller to control operation of the exposure device and the transfer device to transfer a yellow mark to a partial region of the non-image region corresponding to an interval between successive recording media if a print command is input, and to determine an exposure time of one of the photoconductors for formation of a following color developer image on the basis of a sensed time of the yellow mark each time the yellow mark is sensed, wherein the controller determines the exposure time by adding a predetermined time to the sensed time of the mark, and the predetermined time is a time required for the intermediate transfer belt to be fed by a distance between the mark and an image region of the intermediate transfer belt.

13. The apparatus according to claim 12, wherein the controller controls operation of the exposure device and the transfer device to transfer the yellow mark to the region of the intermediate transfer belt corresponding to the interval between successive recording media on a per recording medium basis.

14. The apparatus according to claim 13, wherein the controller determines the exposure time of the respective photoconductors for formation of the following color developer images based on the sensed time of the yellow mark each time the yellow mark is sensed.

15. A method of controlling printing time for an image forming apparatus, comprising:

detecting a time by sensing a mark on an intermediate transfer belt;

determining an exposure time, using the detected time, for formation of a following color developer image;

developing an electrostatic latent image for the determined exposure time; and transferring and fusing the developed electrostatic latent image on a printing medium, wherein the exposure time is determined by adding a predetermined time to the detected time, and the predetermined time is a time required for the intermediate transfer belt to be fed by a distance between the mark and an image region of the intermediate transfer belt.

16. The method of claim 15, further comprising:

adding the mark on the intermediate transfer belt.

* * * * *

UNITED STATES PATENT AND TRADEMARK OFFICE

CERTIFICATE OF CORRECTION

PATENT NO. : 8,391,758 B2
APPLICATION NO. : 12/970353
DATED : March 5, 2013
INVENTOR(S) : Sung Dae Kim et al.

It is certified that error appears in the above-identified patent and that said Letters Patent is hereby corrected as shown below:

In the Claims

Column 10, Line 21, In Claim 9, delete “a the” and insert -- the --, therefor.

Column 10, Line 50, In Claim 11, delete “on per a” and insert -- on a per --, therefor.

Column 10, Line 57, In Claim 12, delete “cyan.,” and insert -- cyan, --, therefor.

Signed and Sealed this
Thirteenth Day of August, 2013

Teresa Stanek Rea
*Acting Director of the United States Patent and Trademark Office*